US008555828B2

(12) United States Patent
Jones

(10) Patent No.: US 8,555,828 B2
(45) Date of Patent: Oct. 15, 2013

(54) PISTON AND USE THEREFOR

(76) Inventor: Leslie Malcolm Jones, Mackay (AU)

( * ) Notice: Subject to any disclaimer, the term of this patent is extended or adjusted under 35 U.S.C. 154(b) by 0 days.

(21) Appl. No.: 13/395,714

(22) PCT Filed: Sep. 14, 2010

(86) PCT No.: PCT/AU2010/001193
§ 371 (c)(1),
(2), (4) Date: May 1, 2012

(87) PCT Pub. No.: WO2011/029160
PCT Pub. Date: Mar. 17, 2011

(65) Prior Publication Data

US 2012/0227708 A1 Sep. 13, 2012

(30) Foreign Application Priority Data

Sep. 14, 2009 (AU) ..... 2009904424
Sep. 14, 2010 (WO) ..... PCT/AU2010/001193

(51) Int. Cl.
*F01L 11/02* (2006.01)
*F02B 75/22* (2006.01)

(52) U.S. Cl.
USPC ..... 123/47 A; 123/47 R; 123/55.2; 123/55.7; 123/74 R

(58) Field of Classification Search
USPC ..... 123/47 A, 47 R, 74 R, 55.1, 55.2, 55.3, 123/55.4, 55.6, 55.7, 74 A, 74 AA, 74 AP, 123/74 AC, 74 AE, 74 B, 74 C, 74 D, 53.3
See application file for complete search history.

(56) References Cited

U.S. PATENT DOCUMENTS

| | | | | |
|---|---|---|---|---|
| 1,433,649 | A * | 10/1922 | Powell | 123/65 V |
| 1,756,354 | A * | 4/1930 | Heibig | 123/66 |
| 4,791,892 | A * | 12/1988 | Hall | 123/47 R |
| 4,932,373 | A * | 6/1990 | Carson | 123/197.4 |
| 7,104,227 | B2 * | 9/2006 | Roberts | 123/55.7 |
| 7,194,989 | B2 * | 3/2007 | Hallenbeck | 123/56.1 |
| 2010/0040497 | A1 * | 2/2010 | Mohamed | 417/552 |

FOREIGN PATENT DOCUMENTS

| | | |
|---|---|---|
| CN | 2327791 | 7/1999 |
| DE | 19705178 | 1/1998 |
| DE | 19742552 | 9/1998 |
| DE | 19925445 | 12/2000 |
| DE | 10025873 | 11/2001 |
| WO | 9835140 | 8/1998 |

* cited by examiner

*Primary Examiner* — Thanh K Truong
*Assistant Examiner* — Tea Holbrook
(74) *Attorney, Agent, or Firm* — Jason F. Cotter; Gregory J. Winsky; Archer & Greiner, P.C.

(57) ABSTRACT

The invention provides a piston which allows pressure generated downstream from the piston to be used to ventilate a combustion chamber of a cylinder in which the piston is slidingly mounted. The crank assembly to which the piston is connected is operable outside of the cylinder which is sealed at both ends. The crank assembly uses eccentric motion to allow a connecting rod which extends between the piston and the crank assembly to move linearly into and out of the cylinder in sealed manner. The piston includes a valve which allows pressurized gas to flow through the piston.

22 Claims, 8 Drawing Sheets

PISTON AND USE THEREFOR

FIELD OF THE INVENTION

The invention generally relates to a piston and more particularly is concerned with piston which can be used in a piston cylinder assembly having an improved compression configuration.

Whilst the invention may be used in any type of piston cylinder assembly including those used for compressing air, for convenience sake it shall be described herein in terms of being used in an internal combustion engine.

BACKGROUND TO THE INVENTION

Internal combustion engines are in widespread use and are used to power crafts and vehicles of different sizes ranging from small radio controlled aeroplanes to large ocean going vessels such as oil tankers. It is therefore not surprising that internal combustion engines are constructed using a wide variety of different configurations which typically used to classify the engine. Common configurations include two or four strokes and a Wankel engine (also commonly called a rotary engine) although other configurations exist such as using five- and six-cycles, a diesel cycle or a Brayton cycle.

A primary concern in engine design is improving the power-to-weight ratio of the engine. For example, although Wärtsilä RTA96-C 14-cylinder two-stroke Turbo Diesel engine produces a peak power output of 80,080 kW, due to the size of the engine the power-to-weight ratio of the engine is only 0.03 kW/kg. A marginally better power-to-weight ratio is produced by a Suzuki 538cc V2 4-stroke gas (petrol) outboard Otto engine which has a peak power output of 19 kW resulting in a power-to-weight ratio of only 0.27 kW/kg. A Wankel engine configuration achieves a better power-to-weight ratio of 1.15 kW/kg from a 184 kW engine. BMW has achieved a power-to-weight ratio of 7.5 kW/kg with their 690 kW BMW V10 3L P84/5 2005 gas (petrol) Otto engine. Is therefore clear that different engine configurations achieve different power-to-weight results and that a balance must be struck between achieving a desired amount of kilowatts on the one hand and the weight of the engine on the other hand.

A commonly used configuration in motorised road vehicles is the four-stroke or Otto design. Typically such an engine has four strokes from one combustion stroke to the next. An air mixture containing a flammable liquid such as high octane petroleum is compressed inside a piston-cylinder assembly. This compressed air mixture is ignited at a predetermined time thereby causing in the combustion stroke the piston to move away from a cylinder head of the piston-cylinder assembly. This linear movement of the piston is transferred through a crank to one or more wheels of the vehicle through a drive train or gearbox. Although typically such an engine has a sufficient power-to-weight ratio for use with a vehicle, it is often required to improve this power-to-weight to increase the fuel efficiency of the vehicle.

Otto engines normally deliver a maximum amount of torque at high revolutions which, when the engine is often revved to a high revolution, could result in reducing the life span of the engine. This may be undesirable.

A further aspect which greatly determines the live span of an engine is the configuration on which the engine is based. In an Otto design engine the piston travels four times along the length of the cylinder from one compression stroke to the next. Accordingly, such engines will therefore have a shorter life span than an engine which is based on a configuration using fewer strokes, for example a two-stroke engine.

Often an engine incorporates more than one piston irrespective of its configuration. Due to the mechanical forces operating inside the engine, it is critical that the engine is balanced as far as possible. As a result, engines ordinarily include an even number of pistons thereby allowing the number of pistons to be grouped in smaller groups each having an even number of pistons. This allows the smaller groups of pistons to move in unison and preferably in an opposite direction than another small group of pistons. However, the use of smaller groups of pistons may still cause the engine to become unbalanced.

In conventional engine configurations linear movement of the pistons are converted into rotational movement by the crank to which the pistons are connected. This connection typically requires a connection rod extending between a respective crank pin and piston to move, apart from linearly, also from side to side. The side to side movement, although being partly accommodated and countered by the crank and the flywheel, nonetheless causes some unbalancing of the engine and increases stresses being placed on other moving components of the engine. It therefore can be desirable to improve the balance with which components move inside the engine and thereby reducing stresses placed on moving components inside the engine.

SUMMARY OF THE INVENTION

Accordingly, it is an object of the present invention to at least partly overcome or ameliorate at least one of the disadvantages of the prior art.

The invention generally provides a piston which includes at least one piston valve the operation of which allows pressure, generated on one side of the piston, to be released on an opposed side of the piston.

In one embodiment, the invention provides a piston which includes a piston body having a first end and an opposed, second end; the piston body capable of being sealingly mounted for sliding movement inside a cylinder; and wherein a piston valve is mounted to the piston body; and wherein operation of the piston valve allows pressure generated on one of the first and second sides of the piston body through sliding movement inside the cylinder to be released to the other of the first and second sides of the piston body.

The piston valve may include a valve stem and a tapered plug which extends from one end of the stem; and wherein the piston body includes a passage which extends through the piston body between the first and second ends and which has a valve seat formed into the first end; and wherein the piston valve is biased towards a closed position at which the tapered plug is sealingly engaged with the valve seat; and wherein the valve stem is accessible from the second end of the piston thereby allowing movement of the piston valve from the closed position so that pressure generated on the second side of the piston body is allowed to escape between the tapered plug and the valve seat.

The piston body may include a biasing member in the form of a compression spring which operates inside the passage thereby causing the piston valve to be biased towards the closed position. The passage may include at least one pair of strut members which support the piston valve on the valve stem thereby to guide longitudinal movement of the piston valve to and from the closed position. The strut members may include a number of perforations which allow pressurised gas, for example in the form of air, to pass through the piston body once the piston valve has been moved from the closed position.

In a further embodiment of the invention, there is provided for an internal combustion engine which incorporates a piston substantially as hereinbefore described; the internal combustion engine includes an engine body which includes at least one cylinder having a first end and an opposed, second end; the piston is slidingly mounted inside the cylinder; and a crankshaft assembly which is connected to the piston; a first chamber is formed inside the cylinder between the piston and the first end and a second chamber is formed inside the cylinder between the piston and the second end; wherein the crankshaft assembly is positioned outside the first and second chambers; wherein each of the first and second ends of the cylinder is sealed thereby allowing movement of the piston towards the first end to cause the first chamber to become pressurised and movement of the piston to the second end causes the second chamber to become pressurised; wherein the piston is connected to the crankshaft assembly thereby allowing linear movement of the piston between the first and second ends of the cylinder to cause rotational movement in the crankshaft assembly; wherein rotational movement of the crankshaft assembly causes the piston valve to open and close; and wherein pressure formed in the second chamber is used to ventilate the first chamber through operation of the piston valve.

The engine body may include an engine block or cylinder casing which houses the cylinder and which allows the crankshaft assembly to operate outside of the sealed cylinder.

The first end of the cylinder may be sealed by securing a cylinder head to the cylinder casing. The second end of the cylinder may be sealed once a connecting rod which connects the second end the piston to the crankshaft assembly is fitted to a bushed aperture formed in an inner portion of the cylinder casing which define the second end of the cylinder.

The engine body may include two cylinder casings which are mounted opposite to each other with the crankshaft arrangement operating between the two cylinder casings. The cylinder casings may be secured to each other using a suitable housing which allows the two cylinder casings to be secured to be housing using suitable fasteners.

The cylinder of each of the two cylinder casings may be longitudinally aligned; wherein the piston of each of the two cylinders may be connected at the same point to the crankshaft assembly. A connecting rod shaft may act between the two pistons so that movement of one of the two pistons towards the second end of the respective cylinder causes movement of the other of the two pistons towards the first end of the respective cylinder. The connecting rod shaft may be assembled from first and second connecting rod sections each of which is secured at one end to a piston and at an opposed end to the other of the first and second connecting rod sections.

In a further embodiment, the invention also extends to a crankshaft assembly which in use allows operation of a piston valve of a piston substantially as hereinbefore described; the crankshaft assembly including a flywheel which includes a crank pin which extends off centre from the flywheel; wherein a support member is mounted to the crank pin thereby allowing the support member to rotate about the crank pin; wherein the support member carries a connecting rod support pin to which is secured one end of a connecting rod with an opposed, second end of the connecting rod being secured to the piston; and wherein a pushrod is slidingly mounted to the connecting rod so that longitudinal movement of the connecting rod causes movement in the piston valve of the piston; and wherein a cam member is carried by the connecting rod support pin so that rotational movement of the support member about the crank pin causes rotational movement of the cam member thereby causing longitudinal movement in the connecting rod.

The flywheel may be toothed on a periphery of the flywheel. A circular end surface of the flywheel may be toothed.

The flywheel may include a recessed portion which is profiled and dimension to allow the support member to be inserted into the flywheel for rotation about the crank pin.

The connecting rod support pin may include an annular groove so that the cam member is formed into the connecting rod support pin. The connecting rod may include a passage which extends through the connecting rod thereby allowing the pushrod to be fitted for longitudinal movement inside the connecting rod.

One end of the pushrod may be positioned inside the annular groove once a crankshaft mounting end of the connecting rod is secured to the connecting rod support pin so that the respective end of the pushrod runs inside the annular groove across an outer cam member surface as the support member rotates about the crank pin.

The crankshaft mounting end of each of the first and second connecting rod sections may be secured to each other thereby allowing the crankshaft mounting ends to be mounted for pivotal movement about a central axis of the connecting rod support pin.

The crankshaft assembly may include two spaced apart flywheels each of which is positioned on a side of the connecting rod shaft; and wherein each of the two spaced apart flywheel carries an associated support member which is mounted for pivotal movement about a crank pin of the flywheel; and wherein the connecting rod support pin extends between the two support members so that the connecting rod shaft moves longitudinally between the two spaced apart flywheels.

An apex of the cam member may cause the pushrod to move longitudinally towards the body thereby resulting in movement of the piston valve from the closed position. The apex may be positioned thereby allowing the piston valve to move from the closed position once the piston body has moved halfway to the second end of the cylinder; wherein the halving of the second chamber causes the pressure inside the second chamber to double; and wherein the movement of the piston valve from the closed position allows pressurised air inside the second chamber to be ventilated through the piston body to be first chamber.

The first chamber may be used to house a combustible material and the cylinder head may include an outlet valve which allows by-products caused by the combustion to be flow from the first chamber; wherein the outlet valve is opened before the piston valve is caused to move from the closed position; and wherein opening of the piston valve ventilates the first chamber with the compressed air flowing under pressure from the second chamber. Further movement of the piston to the second end the cylinder causes the air remaining inside the second chamber after the piston valve has been moved from the closed position to be forced out of the second chamber into the first chamber.

The cylinder may include a pressure differential valve which allows air to flow from atmosphere into the second chamber. The piston valve is allowed to move to the closed position through rotational movement of the cam member of the crankshaft assembly thereby sealing the second chamber through the piston valve; and wherein movement of the piston from the second end of the cylinder towards the first and of the cylinder causes a reduction in pressure and the second chamber thereby causing air to be drawn through the pressure differential valve into the second chamber.

The internal combustion engine may have a combustion stroke which is half of a length of the cylinder and which causes the piston body to move towards the second end of the cylinder; and wherein the ventilation stroke of the internal combustion engine is caused by further movement of the piston body towards the second end of the cylinder.

The combustion stroke of the piston may have a combustion stroke length; and wherein the outlet valve may be closed at a position of rotational movement of the flywheel thereby allowing air inside the first chamber to be compressed from a position inside the cylinder at which a compression stroke length of the piston is greater than the combustion stroke.

The support member and the flywheel may rotate in opposite directions when the piston moves towards the second end of the cylinder. The rotation in opposite directions of the support member and the flywheel may allow the connecting rod extending between the piston and the crankshaft assembly to move in a straight line towards and from the crankshaft assembly.

The support member may have an outer surface which is substantially planar with an outer surface of the flywheel when the support member is fitted to the crank pin.

A central axis of the crank pin maybe spaced by a first distance from a central axis of the flywheel which is equal to a second distance with which a central axis of the connecting rod support pin is spaced from the central axis of the crank pin.

In a further embodiment the invention extends to a piston cylinder assembly which includes a cylinder, a piston which is slidingly mounted for movement inside the cylinder, and a crank assembly which is connected to the piston and which operates outside the cylinder; wherein the cylinder has a first end and an opposed, second end of each of which is sealed; wherein a connecting rod linking the piston to the crank assembly extends sealingly through the second end of the cylinder; and wherein the crank assembly allows the connecting rod to move linearly into and out of the cylinder.

In another embodiment of the invention there is provided for a piston cylinder assembly which includes a cylinder, a piston which is slidingly mounted for movement inside the cylinder, and a crank assembly which is connected to the piston and which operates outside the cylinder; wherein the cylinder has a first end and an opposed, second end of each of which is sealed; wherein a connecting rod linking the piston to the crank assembly extends sealingly through the second end of the cylinder; wherein the crank assembly allows the connecting rod to move linearly into and out of the cylinder; wherein the piston divides the cylinder into a first chamber which lies adjacent the first end and a second chamber which lies adjacent the second end; and wherein pressure generated inside the second chamber through movement of the piston towards the second end is used to ventilate the first chamber.

BRIEF DESCRIPTION OF THE DRAWINGS

In order that the invention can be more readily understood the invention is further described by way of example with reference to the accompanying drawings.

DESCRIPTION OF ILLUSTRATED EMBODIMENTS OF THE INVENTION

Figure 1:
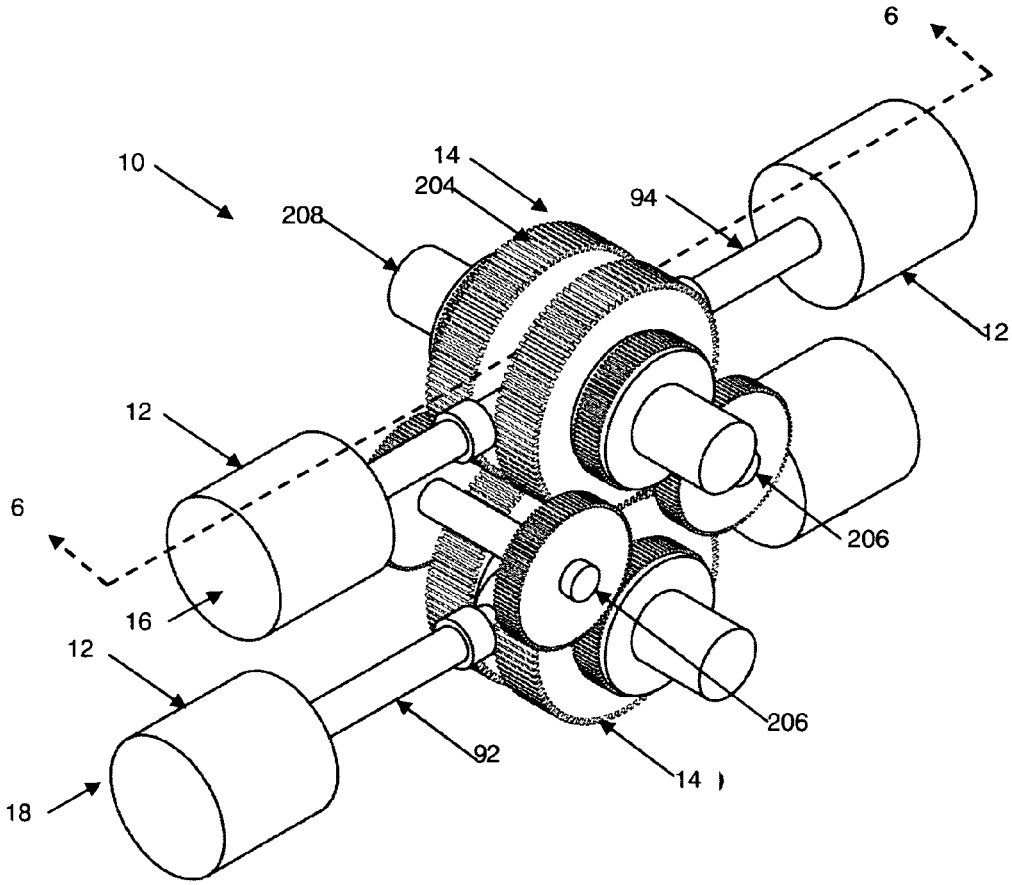
FIG. 1 is a schematic illustration in perspective showing pistons and crank assemblies of an internal combustion engine according to the invention.
Figure 2:
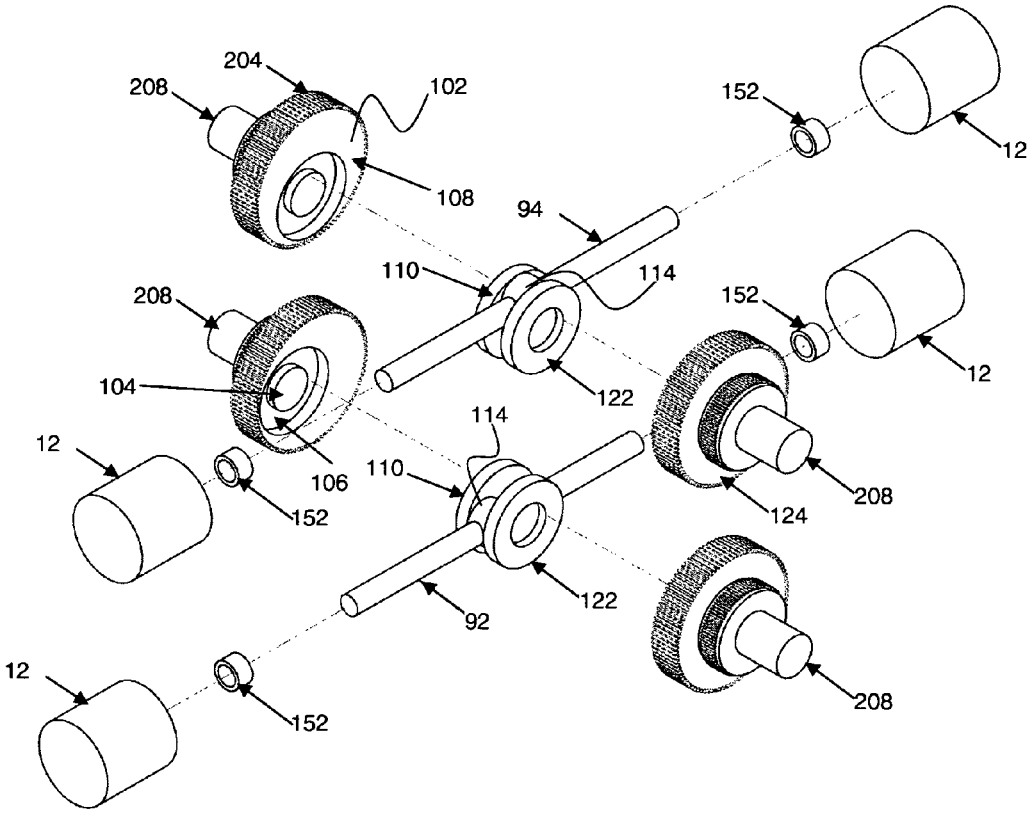
FIG. 2 is a schematic illustration showing the components used in the assembly of FIG. 1.
Figure 3:
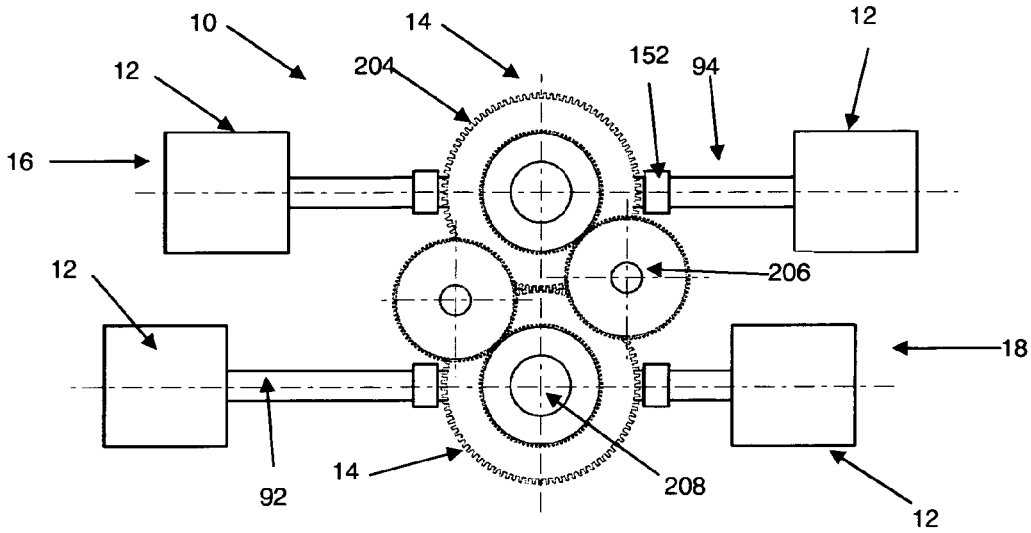
FIG. 3 is a schematic illustration from one side of the pistons and crankshaft assemblies shown in FIG. 1.

FIG. 1 of the accompanying representations illustrates an internal combustion engine 10 according to the invention. The internal combustion engine includes a number of pistons 12 (in this illustration four) which are connected to a number of crankshaft assemblies 14. The pistons work in pairs 16 and 18 each of which operates substantially on an identical manner. For this reason the operation of the pair of pistons 16 will be discussed in greater detail hereinafter with particular reference to FIG. 6 to 9. The interaction between the crankshaft assemblies will then be described in greater detail thereafter.

Figure 6:
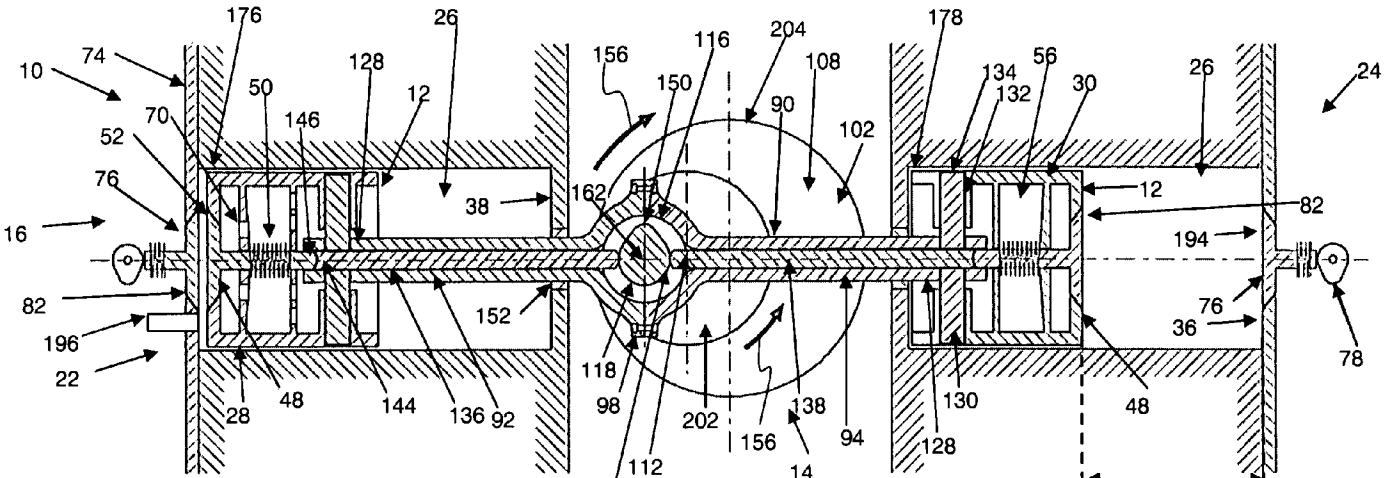
FIG. 6 is a cross-sectional side view, taken on a line 6-6 in FIG. 1, of one of the pistons and crankshaft assemblies shown in FIG. 1.

FIG. 6 illustrates the internal combustion engine 10 to include first and second engine block or cylinder casing 22 and 24 which are positioned at opposed side of the crankshaft assembly 14. Since the operation and construction of the pistons 12 are substantially identical in each of the first and second cylinder casings 22 and 24, only the fitment and operation of the piston 12 to the first cylinder casing 22 will be described with greater detail hereinafter.

Figure 7:
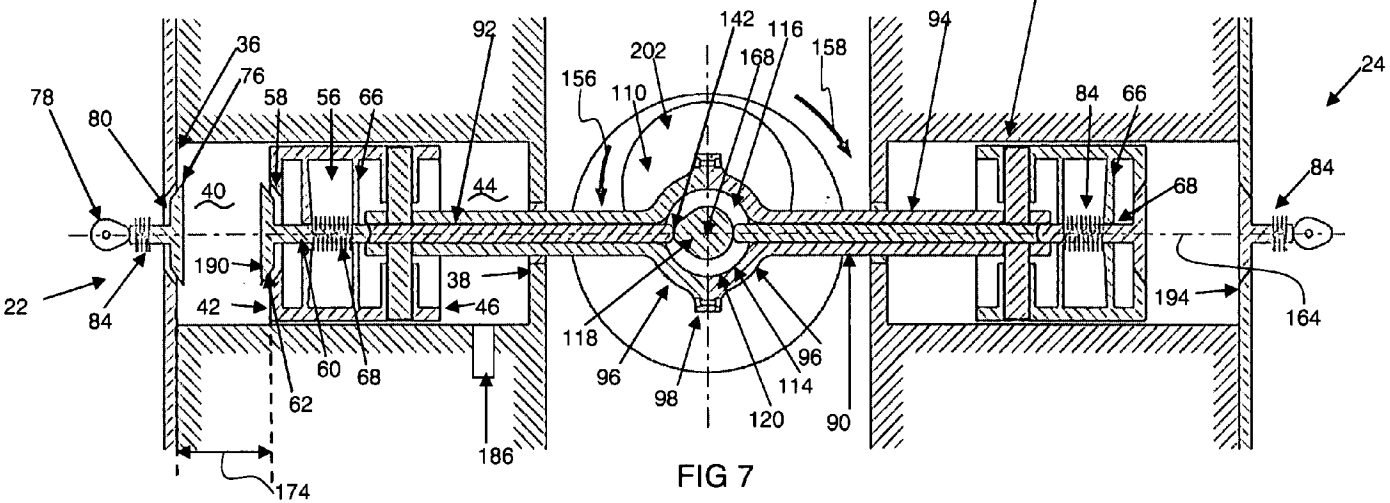
FIG. 7 is a cross-sectional side view of the internal combustion engine shown in FIG. 6 wherein a flywheel of the crankshaft assembly is at 90° rotation.
Figure 8:
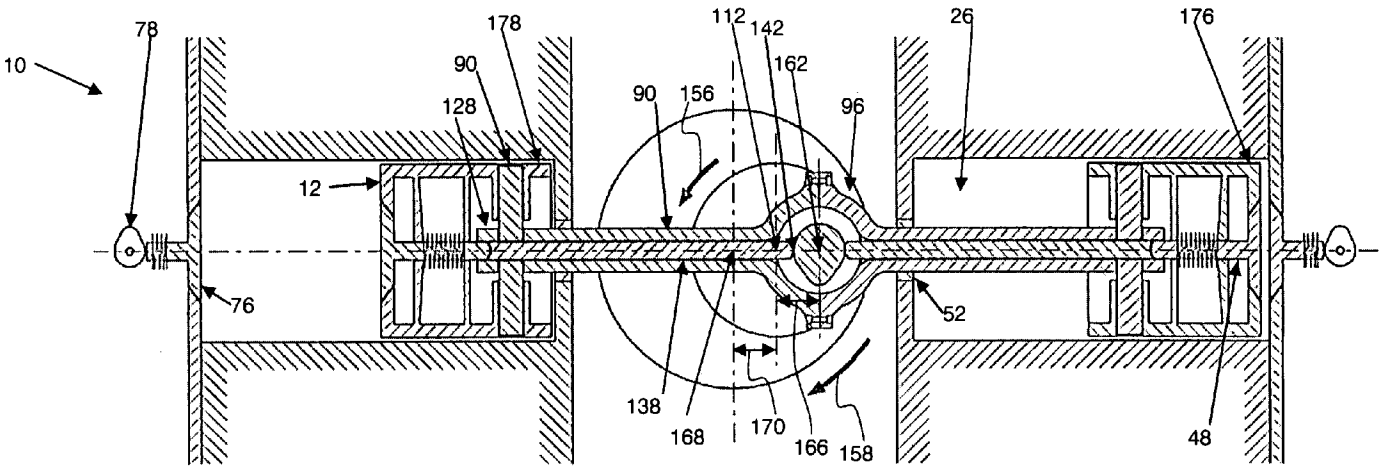
FIG. 8 is a cross-sectional side view of the internal combustion engine shown in FIG. 6 wherein the flywheel of the crankshaft assembly is at 180° rotation
Figure 9:
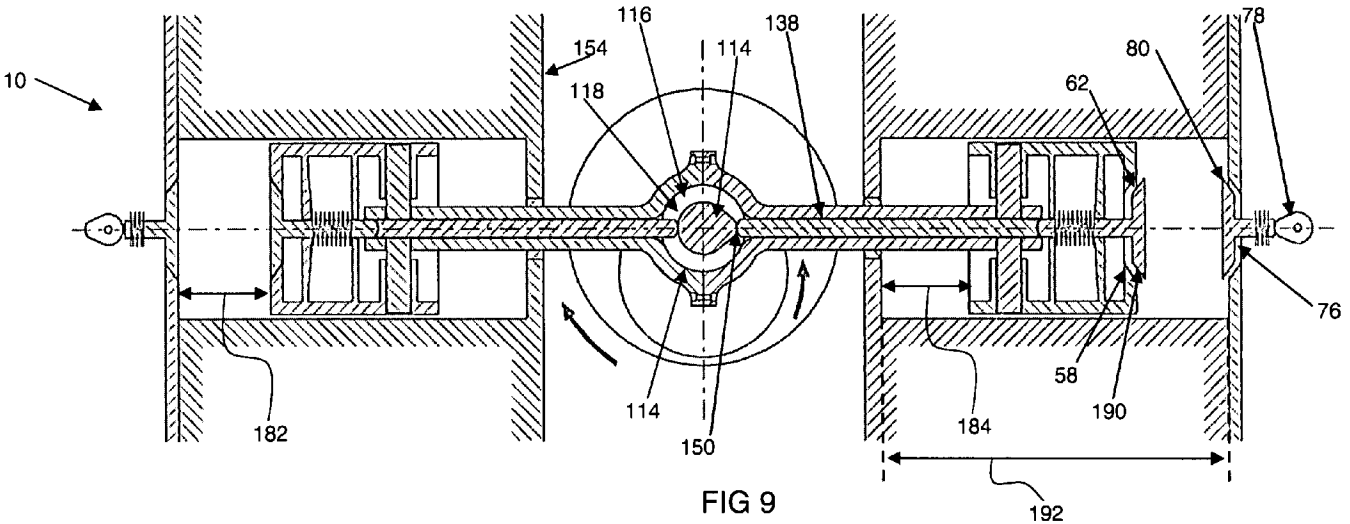
FIG. 9 is a cross-sectional side view of the internal combustion engine shown in FIG. 6 wherein the flywheel of the crankshaft assembly is at 270° rotation.

Each of the pistons 12 is sealingly mounted for sliding movement inside a cylinder 26 of the cylinder casing 22. For example, one or more piston rings, not shown, will be fitted to an outer wall 28 of a piston body 30 of the piston. The piston rings act between the cylinder 26 and the piston body thereby to seal the interface between the outer wall 28 and the cylinder sleeve 32. The cylinder has a first end 36 and an opposed, second end 38. Each of the first and second ends of the cylinder is sealable thereby allowing movement of the piston 12 to create pressure inside the cylinder. Referring in particular to FIG. 7, a first chamber 40 is formed between a first end 42 of the piston body and a second chamber 44 is formed between a second end 46 of the piston body 30 and the second end 38 of the cylinder. Thus, movement of the piston towards the first end of the cylinder causes the first chamber to become pressurised. Conversely, movement of the piston to the second end of the cylinder causes the second chamber to become pressurised.

The piston 12 includes a piston valve 48 which is biased through a biasing member or compression spring 50 to a closed position 52 which is shown in FIG. 6. The piston body includes a passage 56 which extends through the piston body and which includes a valve seat 58 which extends into the passage from the first end 42 of the piston body. The piston valve includes a valve stem 60 and a tapered plug 62 which sealingly rests on the valve seat when the piston valve is in the closed position 52. Thus, the piston valve has to be moved against the biasing action of the compression spring 50 in order to move the tapered plug 62 out of sealing engagement with the valve seat.

The passage 56 includes a pair of strut members 66 each of which extends into the passage to assist movement of the piston valve to and from the closed position 52. The strut members are disc-like and include a central aperture 68 which allows the valve stem to extend through each of the strut members with little lateral play. Each strut members further includes a number of perforations 70 (which are illustrated in FIG. 6) which allow air to pass through the piston body once the piston valve 48 has been moved from the closed position 52. Thus, the pair of strut members performs a dual function of supporting longitudinal movement of the piston valve to and from the closed position as well as allowing air to pass through the passage.

The first end 40 of the cylinder is sealed through engagement of a cylinder head 74 with the first cylinder casing 22. Suitable fasteners, not shown, are used to attach the cylinder head to the first cylinder casing typically with a cylinder head gasket, not shown, positioned between the first cylinder casing and the cylinder head. The cylinder head includes an outlet valve 76 which is operated through a cam shaft 78 which causes the outlet valve to move between an open position 80, shown in FIG. 7, and a closed position shown in FIG. 6. Typically the outlet valve is biased through a valve spring 84 to the closed position 82.

FIGS. 6 to 9 show that the cylinder 26 of the first cylinder casing 22 is aligned with the cylinder 26 of the second cylinder casing 24. This allows the pistons 12 to be connected to each other through a connecting rod shaft 90. The connecting rod shaft consists of a first connecting rod section 92, which extends into the cylinder of the first cylinder casing 22, and a second connecting rod section 94 which extends into the cylinder of the second cylinder casing 24. A crankshaft mounting end or big end 96 of each of the first and second connecting rod sections is secured to each other using suitable fasteners 98.

Referring in particular to FIGS. 1 and 6, the crankshaft assembly 14 has a first flywheel 102 carrying a crankshaft pin 104 formed through a recessed portion 106 which extends into an outer surface 108 of the flywheel. An eccentric or first support member 110 is pivotally mounted to the crankshaft pin for rotational movement about a central axis 112 of the crankshaft pin 104. The first support member carries a connecting rod support pin 114 around which is secured the big ends 96 of the first and second connecting rod sections. The connecting rod support pin includes an annular groove 116 which is formed into the connecting rod support pin so that a cam member 118 is formed in the connecting rod support pin. The cam member has an outer cam member surface 120.

Referring in particular to FIG. 1, the connecting rod support pin 114 is also connected to a second support member 122. Thus, the connecting rod support pin extends between the first and second support members 110 and 122. The second support member 122 is secured to a second flywheel 124 in the same manner as is the first support member 110 to the first flywheel 102. Thus, once the first and second support members are secured respectively to the first and second flywheels, the connecting rod support pin is free to rotate about the central axes 112 of the crankshaft pins 104.

Reverting back to FIG. 6 to 9, a small end 128 of each of the first and second connecting rod sections 92 and 94 is secured using a gudgeon pin 130 to a respective piston 12. The gudgeon pin is fitted to a hole 132 in a gudgeon 134 which is tubular in construction and therefore does not obstruct the passage 56. The gudgeon therefore allows air to pass from the second chamber 44 into the passage.

Each of the first and second connecting rod sections 92 and 94 include a passage 136 which extends through each of the connecting rod sections from the big end 96 to be small end 128. A pushrod 138 is fitted to each passage so that a pushrod extends between opposed ends of the cam member 118. An inner end 142 of each pushrod extends into the annular groove 116 and runs across the outer cam member surface 120. An opposed outer end 144 of each pushrod abuts an end 146 of the valve stem 60 which, through the biasing member 50, forces the inner end 142 into contact with the outer cam member surface.

The operation of the internal combustion engine 10 is described with particular reference to FIG. 6 to 9. In FIG. 6 the engine is shown to have a configuration what is called top dead centre. The piston 12 of the first cylinder casing 22 is now the closest the piston can get to the first end 36 of the cylinder 26 and the piston 12 of the second cylinder casing 24 is the closest the piston can get to the second end 38. An apex 150 of the cam member 118 is also positioned halfway between the inner ends 142 of the pushrods 138. This configuration is once again achieved in FIG. 8 although the apex 150 will be pointing in direction opposite to that shown in FIG. 6.

Rotation of the big ends 96 of the first and second connecting rod sections 92 and 94 about the central axis 112 of the crankshaft pin 104 causes the apex 150 to rotate as the connecting rod support pin 114 also rotates about central axis 112. This rotation of the cam member 118 causes longitudinal movement in the pushrods 138 when the apex 150 moves past the inner ends 142 of the pushrods 138. The longitudinal movement of the pushrods causes the piston valves 48 to move from the closed positions 52 thereby breaking the seal formed between the respective tapered plugs 62 and the valve seats 58.

The connecting rod shaft 90 moves linearly between the cylinders 26 of the first and second cylinder casings 22 and 24. The second end 38 of each of the cylinder contains an carrying a bush 152 which allows the first and second connecting rod sections 92 and 94 to move respectively into and out of the cylinders of the first and second cylinder casings. The bushed apertures are formed in inner portions 154 of the first and second cylinder casings which respectively define the second end 38 of each cylinder.

FIG. 6 to 9 only show the first flywheel 102 and the first support member 110. The second support member 112 and second flywheel 124 have been omitted to simplify these drawings. The first support member is capable of pivotally rotating about the crank pin 104. This allows the first support member to move in a direction 156 which is opposite to a direction 158 in which the first flywheel moves. The movement of the first flywheel and first support member in opposite directions allow the connecting rod shaft 90 to move in a linear manner relative to the first and second cylinder casings 22 and 24. The connecting rod shaft is not capable of moving sideways as some of the traditional connecting rods are able to do. The first support member and the flywheel therefore rotate in opposite directions to accommodate this linear movement of the connecting rod shaft so that a central axis 162 of the connecting rod support pin 114 moves substantially along a central axis 164 of the connecting rod shaft 90.

Due to the construction of the crankshaft assembly 14, it is possible to increase a piston stroke length of the piston 12 without increasing a distance 166 (see FIG. 8) with which the connecting rod support pin rotates about the crank pin 104. In conventional crankshaft assemblies a length of a piston stroke is increased by increasing a distance (which equates to the piston stroke length) with which a central axis of a crankshaft pin rotates about a central axis of the crankshaft. This typical piston stroke length is embodied in the distance 166 with which the central axis 164 of the connecting rod support pin 114 rotate about the central axis 112 of the crankshaft pin 104. Because the crank shaft pin itself rotates about a central axis 168 of the first flywheel 102, a distance 170 between the central axis 168 of the first flywheel and the central axis 112 of the crankshaft pin 104 is added to the piston stroke length. In the particular embodiment of the invention illustrated in FIGS. 6 to 9 the distance 166 is equal to the distance 170 so that effectively the piston stroke length is doubled. In FIGS. 6 to 9 the piston 12 is shown to have a piston stroke 172 which effectively is double that of the distances 166 or 170.

In FIG. 6 the internal combustion engine 10 is at top dead centre. The second chamber 44 in the first cylinder casing 22 now has a maximum volume and the first chamber 40 in the second cylinder casing 24 now has a maximum volume. The first chamber in the first cylinder casing 22 has been pressurised to a maximum pressure and the compressed air inside the first chamber has been mixed with a suitable combustion material such as petrol. Ignition, using a suitable igniter such as a spark plug—not shown, of the pressurised air inside the first chamber causes the piston 12 to move towards the second end 38 of the cylinder 26. This movement causes the piston 12 of the second cylinder casing 24 to move towards the first end 36. FIG. 7 shows the first flywheel 102 at 90° rotation which is half a length 174 of the piston stroke 172. Similarly, the piston 12 of the second cylinder casing 24 has moved half a length of the piston stroke. The 90° rotation of the first flywheel 104 has resulted in an equivalent 90° rotation in the cam member 118 so that the apex 150 of the cam member has been moved towards the inner end 142 of the pushrod 138 extending into the cylinder 26 of the first cylinder casing.

In FIG. 6 the piston 12 of the first cylinder casing 22 is shown to be at a compressed position 176 and the piston of the second cylinder casing 24 is shown to be at a ventilated position 178. Movement of a piston 12 to the compressed position reduces the volume of the first chamber 40 to a minimum and increases the volume of the second chamber 44 to a maximum. Conversely, movement of a piston 12 to the ventilated position reduces the volume of the second chamber 44 to a minimum and increases the volume of the first chamber to a maximum.

In FIG. 7 the pistons 12 of each of the first and second cylinder casings 22 and 24 are shown to be at an intermediate position 180 at which the first end 42 of the piston body 30 is at the start or end of a compression stroke 182 depending on whether the piston is moving towards or from the first end 36 of the cylinder 26. Similarly, a second end 46 of the piston body 30 is at the start or end a ventilation stroke 184, depending on whether the piston is moving towards and from the second end 38 of the cylinder 26.

The cylinder 26 of each of the first and second cylinder casings 22 and 24 has a pressure differential valve 186 (shown in FIG. 7) which allows air to be drawn from atmosphere into the second chamber 44. Thus, movement of the piston 12 from the ventilated position 178, see FIGS. 6 and 8, results in air to be drawn into the second chamber of the second cylinder casing 24 through the pressure differential valve due to the creation of a low pressure area inside the second chamber. Earlier movement of this piston 12 to be ventilated position 178 resulted in substantially most of the air contained in the second chamber 44 to be pushed from the second chamber as the piston moved towards the second end 38. This ventilation of the second chamber is made possible due to the fact that the piston valve 48 is at an open position 190 (see for example the illustration of the piston valve 48 in the first cylinder casing 22 of FIGS. 7 and 9) for most part of the ventilation stroke 184. This opening of the valve allows the piston to push substantially all of the air contained in the second chamber through the passage 56 and into the first chamber 40. This results in the second chamber containing a minimum amount of air when the piston is moved to the ventilated position 178. The piston only has to be moved a short distance to the compressed position 176 before air is drawn into the second chamber through the pressure differential valve 186.

In order to simplify the description of the operation of the internal combustion engine 10, for some part of the description only the operation of the piston 12 of the first cylinder casing 22 will be described with greater detail.

FIGS. 6 to 9 show that the piston 12 only travels twice along a length 192 of the cylinder 26 from one compression stroke 182 to the next. Thus, the internal combustion engine 10 has a two-stroke engine configuration while making use of conventional four stroke components such as valves and camshafts. However, due to the construction of the crankshaft assembly 14, the piston can be seen to have two separate stroke cycles for each piston stroke 172. In the first cycle the piston is moved in the compression stroke 182 from the compressed position 176 to be intermediate position 180. At this point, i.e. with the first flywheel 102 at 90° rotation, the outlet valve 76 is moved to the open position 80 through the cam shaft 78 thereby allowing the pressure generated inside the first chamber 40 to be released. For example, typically the air containing by-products caused by combustion are allowed to escape to atmosphere via an exhaust system. However, a portion of this air may be channelled towards a compression system such as a turbine or compressor for reuse in the internal combustion engine. The invention is therefore not limited in this regard.

At 95° rotation of the first flywheel 102 the piston valve 48 is moved to the open position 190 thereby allowing the pressurised air of the second chamber 44 to flow through the passage 56 into the first chamber 40. It should be noted that movement of the piston to the compressed position 176 causes air to be drawn into the second chamber through the pressure differential valve 186 substantially for an entire length of the piston stroke 172. Thus, movement of the piston towards the first end 36 of the cylinder will continuously cause (until the piston is moved to the compressed position 176) the second chamber to have a lower pressure than atmospheric pressure thereby resulting in air to flow into the second chamber. Therefore, movement of the piston to the intermediate position 180 result effectively in halving of the volume of the second chamber which results in the pressure inside the second chamber to substantially double. The opening of the outlet valve 76 at 90° rotation allows the first chamber 40 to be depressurised until the first flywheel 102 has reached 95° rotation. At this point the apex 150 of the cam member 118 starts bearing against the inner end 142 of the pushrod 138 to an extent which is sufficient to break the seal with which the tapered plug 62 bears against the valve seat 58. This allows the pressurised air, which typically should be in the order of 2 atm due to the halving of the volume of the second chamber, to be released into the first chamber 40 thereby forcing from an inner end 194 of the first chamber 40 the air and any combustion bi-products remaining in the first chamber towards the outlet valve 76. This movement of air through the first chamber improves the ventilation of the first chamber as clean air sourced from the second chamber flows through the first chamber. It should be noted that the apex 150 is shown to be directly underneath the inner end 142 when the flywheel is at 90° rotation. This positioning of the apex is used to merely illustrate the various stages of rotation of the apex and should not be seen as limiting. It will therefore be understood that the apex will be able to force the valve with various degrees from the closed position 52 as the flywheel rotates from 95° rotation onwards to 180° rotation at which the piston valve is once again at the closed position 52. As mentioned above, this will allow movement of the piston 12 for a substantial part of the ventilation stroke 184 to force air from the second chamber into the first chamber.

At 180° rotation of the first flywheel 102 the piston valve 48 is closed thereby sealing off the second chamber as far as the piston body 30 is concerned. Further rotation of the first flywheel causes the piston to move towards the first end 36 of the cylinder 26. However, the outlet valve 76 is also kept in the open position 80 until the first flywheel has reached 270° rotation at which effectively the piston has been moved to the intermediate position 180. This allows the first chamber 40 to be further ventilated as movement of the piston towards the intermediate position forces air to be expelled from the first chamber through the open outlet valve 76.

Thus, the first chamber undergoes three different stages of ventilation. In a first stage the movement of the outlet valve 76 to the open position 80 allows pressurised gas or air caused through the combustion process to be expelled through the open outlet valve. In a second stage the piston valve 48 is open thereby allowing pressurised air to flow from the second chamber 44 into the first chamber. In a third stage the piston valve is allowed to move to the closed position 52 thereby allowing movement of the piston from the ventilated position 178 to the intermediate addition 180 to push a portion of the air contained in the first chamber through the open outlet valve.

It should be noted that the closing of the outlet valve 76 can be advanced to 225° of rotation of the first flywheel 102 thereby effectively allowing a volume of air to be compressed in the compression stroke 182 which is one and half times the volume of the first chamber when the piston 12 has been moved to the end of the compression stroke, i.e. to the intermediate position 180. This allows the piston to compress a larger volume of air than would be possible in a conventional engine.

Fuel is introduced into the first chamber at the appropriate time. For example, fuel may be injected using a fuel injector 196 at approximately 358° of rotation of the first flywheel 102 into the first chamber. Such an application with be suitable for diesel engines and high end petrol engines. Alternatively, fuel can be introduced at around 270° of rotation of the first flywheel thereby allowing fuel to be injected into the first chamber at a low pressure. Ignition of the fuel mixture then occurred at 358° rotation of the first flywheel 102.

In FIG. 6 to 9 the piston 12 of the first cylinder casing 22 is connected using the connecting rod shaft 90 to the piston 12 of the second cylinder casing 24. This allows one of the pistons 12 to be driven through a direct link by momentum caused through the compression stroke of the other of the piston 12. Thus, movement of the piston 12 from the ventilated position 178 to the compressed position 176 is largely assisted by the compression stroke of the piston connected to each other with the connecting rod shaft 90. This may reduce the load which is placed on the crankshaft assembly 14 during the compression stroke of a piston as the piston is directly connected to each other through the connecting rod shaft 90. Furthermore, the weight of the crank assembly is also reduced as the pistons are only connected to one crankshaft pin.

Figure 10:
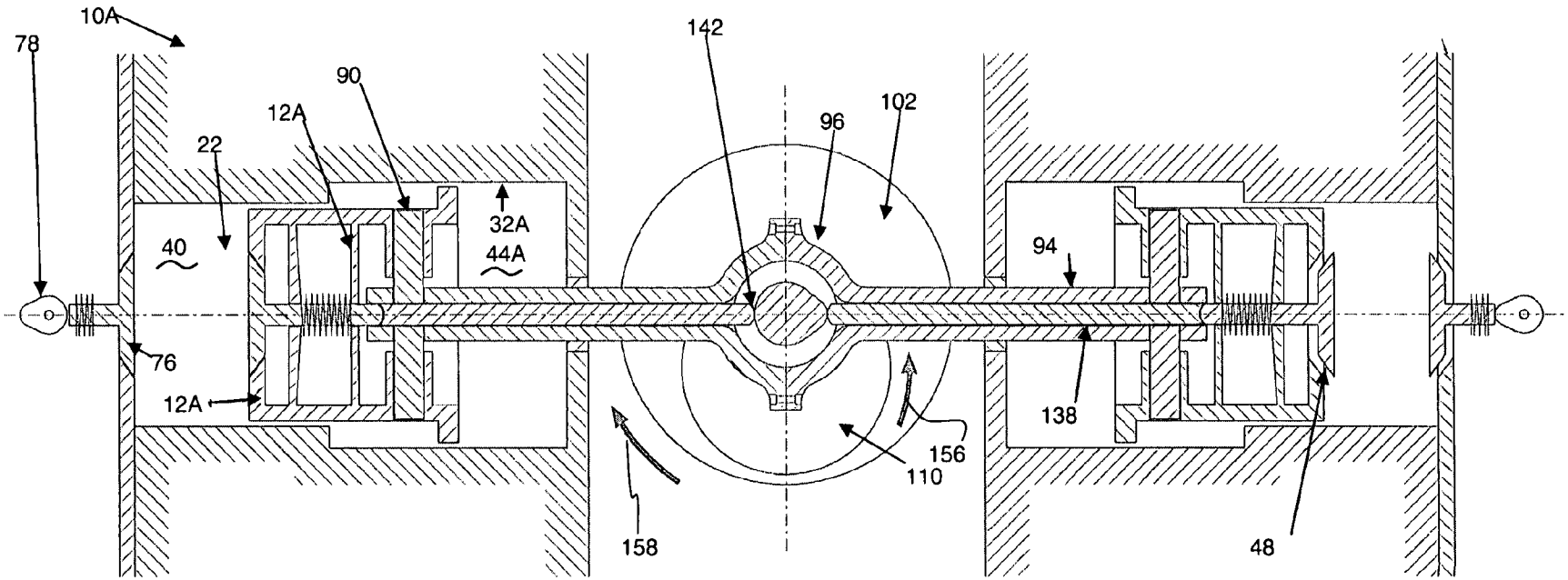
FIG. 10 is a cross-sectional side view of a variation of the internal combustion engine according to the invention which has a stepped cylinder profile.
Figure 11:
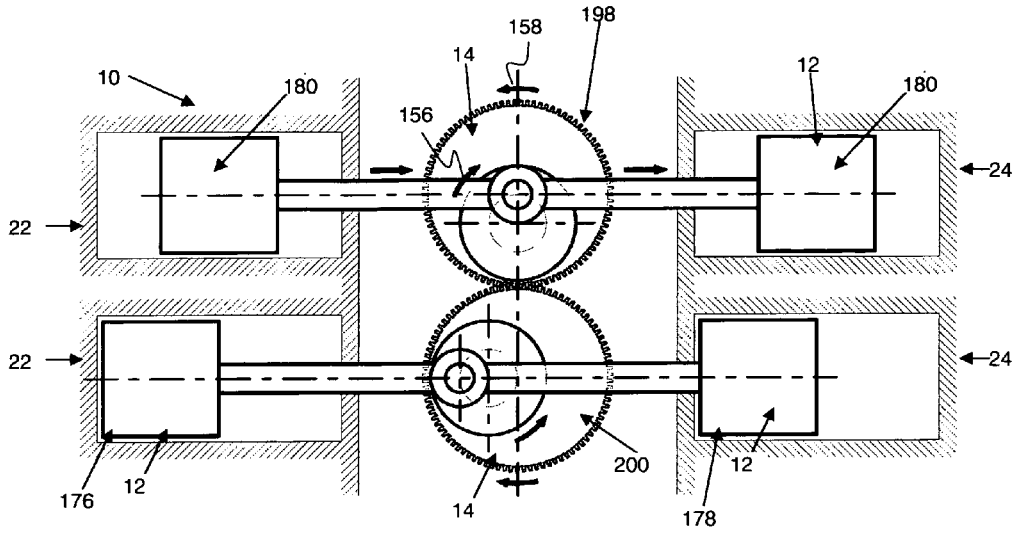
FIGS. 11 to 14 are schematic illustrations of the internal combustion engine shown in FIG. 1 illustrating the various degrees of rotation referred to in FIGS. 6 to 9.
Figure 12:
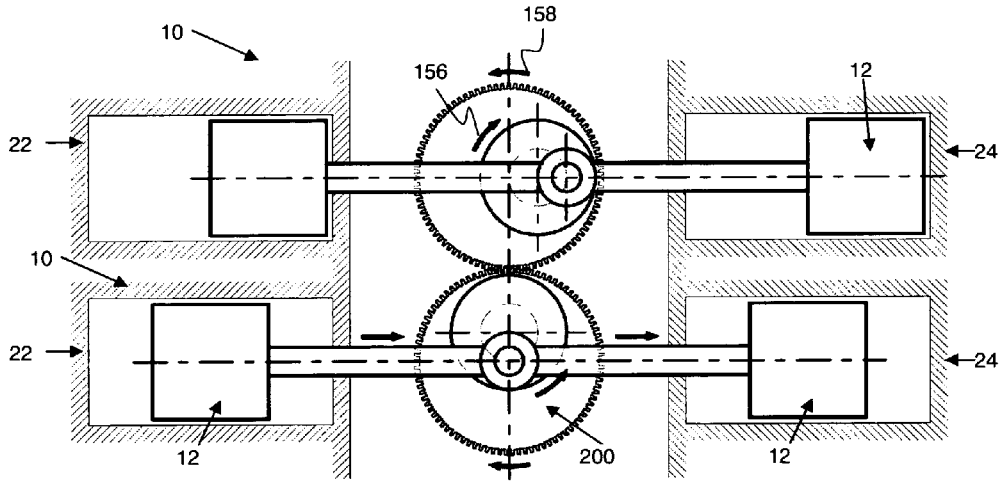
Figure 13:
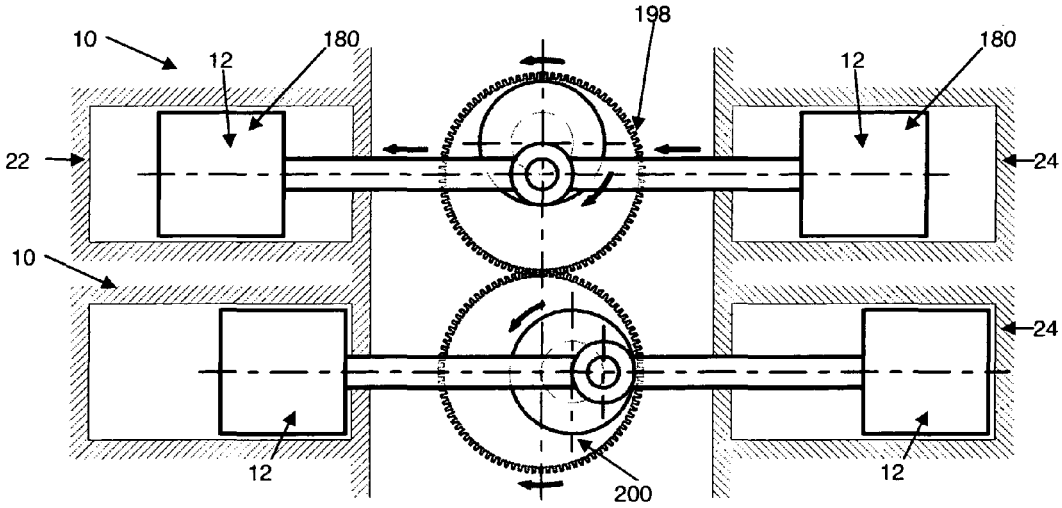
Figure 14:
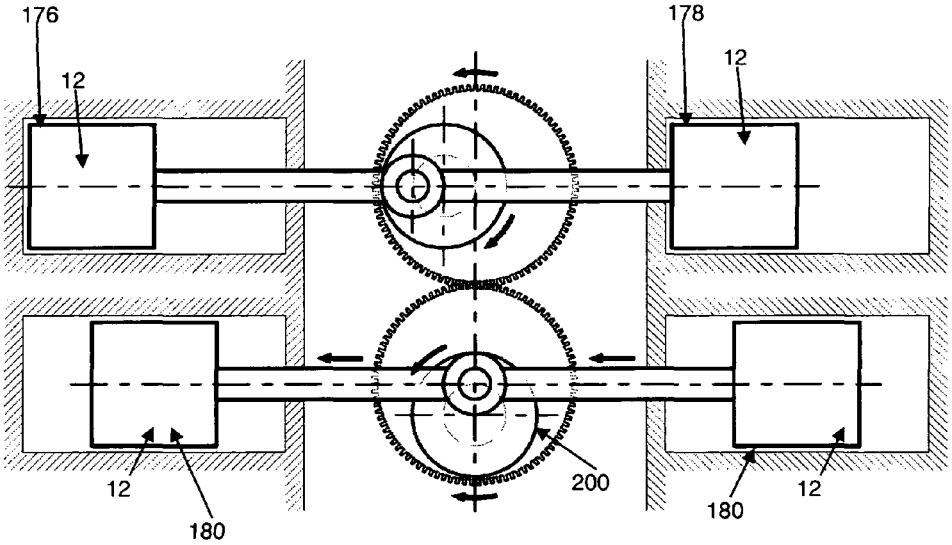

FIG. 10 illustrates a variation 10A of the internal combustion engine according to the invention. Like reference numerals are used to designate like components between the internal combustion engines 10 and 10A. A cylinder sleeve 32A has a stepped profile thereby allowing a second chamber 44A of a cylinder 26 to have an increased volume. This may allow more air to be ventilated through the first chamber 40 as the piston 12A moves towards the ventilated and compressed position 178 and 176.

Figure 4:
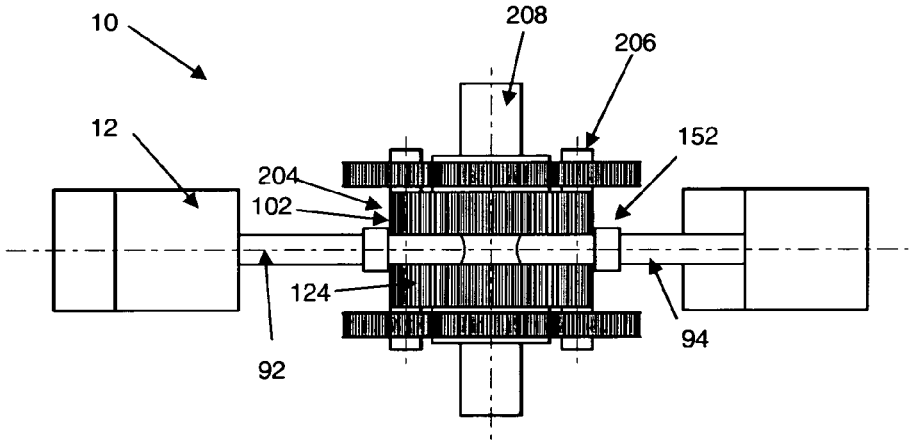
FIG. 4 is a schematic illustration from above of the pistons and crankshaft assemblies shown in FIG. 3.
Figure 5:
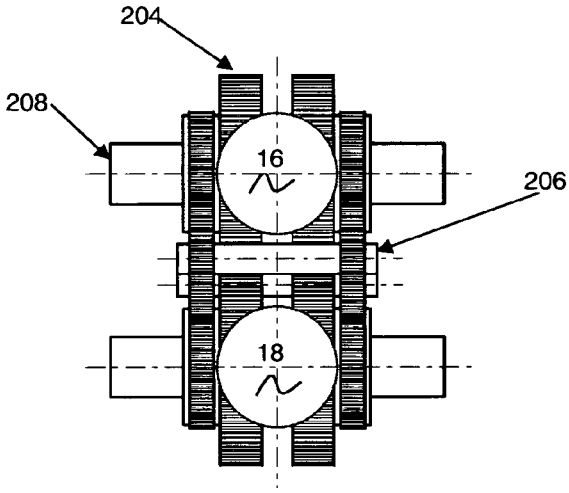
FIG. 5 is a schematic illustration from one end of the pistons and crankshaft assemblies shown in FIG. 4.

Referring in particular to FIGS. 4 to 6, the first support member 110 has an outer surface 202 which is substantially planar with the outer surface 108 of the first flywheel 102. Thus, the first support member is fitted snugly into the recessed portion 106 so that the outer surfaces 108 and 202 align with each other. This fitment allows the first flywheel to be balanced as fitment of the support member result in the outer surface 108 of the first flywheel to be substantially planar.

FIGS. 1, 2 to 5 and 11 to 14 show the interconnecting of first and second pairs of flywheels 198 and 200 each contain one of the first and second flywheels 102 and 124. A circular end surface 204 of each of the first and second flywheels is toothed thereby allowing the first and second flywheels of an adjacent pairs to be meshed. This allows pairs of pistons to be stacked. A number of lay shafts 206 are used to bear against a respective crank shaft outer journal 208 thereby increasing the stability of the meshed crankshaft assemblies 14. The lay shafts also reduce the likelihood of the crank shaft assemblies twisting during rotation or start-up of the internal combustion engine 10.

FIGS. 11 to 14 show possible configuration of how movements of the pistons 12 are interconnected through the crank assemblies 14. Only one of the pistons 12 will be at the compressed position 176 with another being positioned at the start of the compression stroke 182. This allows a piston to be at the compressed position at every 90° rotation of the crank assemblies 14. The pistons are therefore fired in succession and typically at every 90° rotation of the crank assemblies. This is typically not possible with conventional crankshaft designs as normally some of the pistons connected to the crankshaft will only be moved to top dead centre at intervals of 180° rotation of the crankshaft. With the present invention one of the pistons will be at top dead centre at every 90° rotation of the crankshaft assemblies.

It should also be noted that the internal combustion engine of the present invention can be configured as an in-line engine, a v-engine or a flat engine. However, a flat arrangement is preferred as is able to allow two pistons to be connected with the connecting rod shaft 90. With the in-line and v-engine configurations, the use of only one of the first and second connecting rod sections 92 and 94 will be used to connect the piston 12 to the respective crank pin 104.

It should also be noted that the internal combustion engine 10 of the present invention is positively aspirated as air, drawn from atmosphere, is forced from the second chamber 44 into the first chamber 40 when the piston 12 is moved from the ventilated position 178 to the compressed position 176. This allows the first chamber to be sufficiently aerated even at high revolutions at which normally aspirated engines may struggle to draw a sufficient volume of air into a cylinder for compression.

The construction of the internal combustion engine 10 according to the invention includes a number of benefits of the traditional engine configurations. These benefits include allowing the internal combustion engine 10 to have a reduced weight as the cylinder head will have less moving parts, i.e. only one cam shaft is required to operate the outlet valve where as with the traditional engines one or more camshafts are required to operate two or more banks of valves. Furthermore, the closing of the outlet valve may be advanced to 225° rotation of the flywheels thereby allowing effectively 150% of air to be compressed in the compression stroke when compared to the amount of air which potentially can be housed at the end of the compression stroke of a conventional engine. This would allow the compressed air to have more oxygen which will increase the effectiveness of the combustion process. Furthermore, the crankshaft assembly is contains two flywheels which oppose each other and each of which contains an eccentric or support member which is fitted into a side of the flywheel. This fitment increases the balance which flywheel is may have once assembled. Furthermore, as each flywheel will have its own moment of inertia (which provides stability to the crankshaft assembly) combining two flywheels opposite to each other further increases the stability of the crank assembly through the combined moments of inertia. Additionally, allowing opposed pistons to operate in tandem through one connection rod allows, at least when combined with the combined moments of inertia of the paired flywheels, to increase the balance of the engine. Also, having a smaller crankshaft assembly reduces the overall weight of the internal combustion engine which, when combined with the increased compression ratio, increases the power to weight ratio of the engine.

The invention provides a piston which allows air to be transferred through the piston body from one chamber of a cylinder to another of the same cylinder. The invention also provides a crankshaft assembly which allows through eccentric rotation linear movement of a connecting rod into and out of from a cylinder. The linear movement of the connecting rod allows both ends of the cylinder to be sealed with the crankshaft assembly positioned outside of the cylinder. The piston of the present invention also moves with a two-stroke configuration between compression strokes. One cylinder stroke of the piston includes a compression stroke and a ventilation stroke which allows remnants of the combustion process to be forced to pressurised air generated inside the cylinder. The piston divides the cylinder into two halves with combustion occurring in one half and compression occurring in another. Air used in the combustion process is drawn from the compressed air generated in the other half of the cylinder. The piston, through eccentric movement of the crankshaft assembly, is also able to compress, in the compression stroke, a volume of air and which is greater the volume of the chamber at the end of the compression stroke. The internal combustion engine also requires only one cam shaft to operate in a cylinder head. This reduces the overall weight of the engine as well as the overall friction factor of the engine which is further improved due to the fact that the internal combustion engine has a two-stroke configuration.

While we have described herein a particular embodiment of a piston and use therefor, it is further envisaged that other embodiments of the invention could exhibit any number and combination of any one of the features previously described. However, it is to be understood that any variations and modifications which can be made without departing from the spirit and scope thereof are included within the scope of this invention.

The claims defining the invention are as follows:

1. An internal combustion engine which includes an engine body having at least one cylinder having a first cylinder end and an opposed, second cylinder end; a piston which is sealingly mounted for slidingly movement inside the cylinder and which includes a first piston end and an opposed, second piston end; and a crankshaft assembly which is connected to the piston; the piston having a piston body and including a piston valve which is mounted to a passage which extends through the piston body; the piston body includes a biasing member in the form of a compression spring which operates inside the passage thereby causing the piston valve to be biased towards a closed position; the passage includes at least one pair of strut members which support the piston valve through a valve stem thereof thereby to guide longitudinal movement of the piston valve to and from the closed position at which the passage is sealed by the piston valve; wherein first and second cylinder ends are sealed with the crankshaft assembly positioned outside of the sealed cylinder thereby forming a first chamber inside the sealed cylinder between the piston and the first cylinder end and a second chamber inside the sealed cylinder between the piston and the second cylinder end so that the crankshaft assembly is positioned outside the first and second chambers; wherein movement of the piston towards the first cylinder end causes the first chamber to become pressurised and movement of the piston to the second cylinder end causes the second chamber to become pressurised; wherein the piston is connected to the crankshaft assembly through the sealed second cylinder end thereby allowing for linear movement of the piston between the first and second cylinder ends to cause rotational movement in the crankshaft assembly; wherein rotational movement of the crankshaft assembly causes the piston valve to move to and from the closed position thereby allowing pressure formed in the second chamber through movement of the piston to ventilate the first chamber.

2. An internal combustion engine according to claim 1 wherein the piston valve includes a tapered plug which extends from one end of the valve stem; the a passage has a valve seat formed into the first piston end; the piston valve in the closed position causes the tapered plug to sealingly engaged with the valve seat; and wherein movement of the piston valve from the closed position allows pressure generated in the second chamber to escape between the tapered plug and the valve seat into the first chamber thereby to ventilate the first chamber with pressurised air from the second chamber.

3. An internal combustion engine according to claim 2 wherein the strut members include a number of perforations which allow gas pressurised inside the second chamber to pass through the piston body once the piston valve has been moved from the closed position.

4. An internal combustion engine according to claim 1 wherein the engine body includes an engine block or cylinder casing which houses the cylinder and which allows the crankshaft assembly to operate outside of the sealed cylinder and wherein the first cylinder end is sealed by securing a cylinder head to the cylinder casing; and wherein the second cylinder end is sealed once a connecting rod, which connects the second piston end to the crankshaft assembly, is fitted to a bushed aperture formed in an inner portion of the cylinder casing which defines the second cylinder end.

5. An internal combustion engine according to claim 1 wherein the engine body includes two cylinder casings which are mounted opposite to each other with the crankshaft arrangement operating between the two cylinder casings; and wherein the cylinder casings are secured to each other.

6. An internal combustion engine according to claim 5 wherein the cylinder of each of the two cylinder casings is longitudinally aligned; wherein the piston of each of the two cylinders is connected at the same point to the crankshaft assembly.

7. An internal combustion engine according to claim 6 wherein a connecting rod shaft acts between the two pistons, mounted inside the respective cylinder of each of the two cylinder casings, so that movement of one of the two pistons towards the second cylinder end of the respective cylinder causes movement of the other of the two pistons towards the first cylinder end of the respective cylinder and wherein the connecting rod shaft is assembled from first and second connecting rod sections each of which is secured at one end to a piston and at an opposed end to the other of the first and second connecting rod sections.

8. An internal combustion engine according to claim 1 wherein the crankshaft assembly including a flywheel which includes a crank pin which extends off centre from the flywheel; wherein a support member is mounted to the crank pin thereby allowing the support member to rotate about the crank pin; wherein the support member carries a connecting rod support pin to which is secured one end of a connecting rod with an opposed, second end of the connecting rod being secured to the piston; and wherein a pushrod is slidingly mounted to the connecting rod; and wherein a cam member is carried by the connecting rod support pin so that rotational movement of the support member about the crank pin causes rotational movement of the cam member thereby causing longitudinal movement in the connecting rod thereby causing movement in the piston valve of the piston.

9. An internal combustion engine according to claim 8 wherein the connecting rod support pin includes an annular groove so that the cam member is formed into the connecting rod support pin; wherein an apex of the cam member causes the pushrod to move longitudinally towards the piston body thereby resulting in movement of the piston valve from the closed position.

10. An internal combustion engine according to claim 9 wherein the connecting rod includes an internal passage which extends through the connecting rod thereby allowing the pushrod to be fitted for longitudinal movement inside the connecting rod.

11. An internal combustion engine according to claim 10 wherein one end of the pushrod is positioned inside the annular groove once a crankshaft mounting end of the connecting rod is secured to the connecting rod support pin so that the respective end of the pushrod runs inside the annular groove across an outer cam member surface as the support member rotates about the crank pin.

12. An internal combustion engine according to of claim 11 wherein the apex is positioned relative to the pushrod so that the piston valve is moved from the closed position through rotational movement of the apex once the piston body has moved halfway to the second end of the cylinder to which the piston is mounted for slidingly movement inside the cylinder thereby substantially halving the second chamber so the pressure inside the second chamber is effectively doubled; and wherein the movement of the piston valve from the closed position allows pressurised air inside the second chamber to be ventilated through the piston body to the first chamber.

13. An internal combustion engine according to of claim 8 wherein the support member and the flywheel rotates in opposite directions when the piston moves towards the second end cylinder; and wherein the rotation in opposite directions of the support member and the flywheel allow the connecting rod extending between the piston and the crankshaft assembly to move substantially in a straight line towards and from the crankshaft assembly.

14. An internal combustion engine according to claim 8 wherein a central axis of the crank pin is spaced by a first distance from a central axis of the flywheel which is equal to a second distance with which a central axis of the connecting rod support pin is spaced from the central axis of the crank pin.

15. An internal combustion engine according to claim 8 wherein the crankshaft assembly including a flywheel which includes a crank pin which extends off centre from the flywheel; wherein a support member is mounted to the crank pin thereby allowing the support member to rotate about the crank pin; wherein the support member carries a connecting rod support pin; wherein the connecting rod shaft is secured at an intermediate position to the connecting rod support pin one and at each to a respective piston of the two cylinder casings; and wherein a pushrod is slidingly mounted to the connecting rod shaft so that longitudinal movement of the connecting rod in one direction causes movement in a piston valve of a piston of one of the two cylinder casings and longitudinal movement of the connecting rod in an opposite direction causes movement in a piston valve of a piston in the other of the two cylinder casings; and wherein a cam member is carried by the connecting rod support pin so that rotational movement of the support member about the crank pin causes rotational movement of the cam member thereby causing reciprocal longitudinal movement in the connecting rod.

16. An internal combustion engine according to claim 15 wherein the connecting rod support pin is secured in between the first and second connecting rod sections; and wherein each of the first and second connecting rod sections carries a pushrod which causes movement of the piston valve of the piston connected to one of the first and second connecting rod sections.

17. An internal combustion engine according to claim 15 wherein the flywheel is toothed on a periphery of the flywheel.

18. An internal combustion engine according to claim 15 wherein the crankshaft assembly includes two spaced apart flywheels each of which is positioned on a side of the connecting rod shaft; and wherein each of the two spaced apart flywheel carries an associated support member which is mounted for pivotal movement about a crank pin of the flywheel; and wherein the connecting rod support pin extends between the two support members so that the connecting rod shaft moves longitudinally between the two spaced apart flywheels and wherein, for each of the pushrod of the first and second connecting rod sections, an apex of the cam member causes the pushrod to move longitudinally towards the respective piston body thereby resulting in movement of the respective piston valve from the closed position.

19. An internal combustion engine according to claim 15 wherein, for the cylinder of each of the two cylinder casings, the associated cylinder head includes an outlet valve and an injector with which a combustible material is capable of being introduced into the first chamber; the outlet valve is capable of allowing by-products caused by the combustion of the combustible material to flow from the first chamber; wherein the outlet valve is opened before the piston valve is caused to move from the closed position; and wherein opening of the piston valve ventilates the first chamber with gas compressed in the second chamber through movement of the piston towards the second cylinder end and wherein further movement of the piston to the second cylinder end causes any gas remaining inside the second chamber after the piston valve has been moved from the closed position to be forced out of the second chamber and into the first chamber.

20. An internal combustion engine according to claim 19 wherein the cylinder includes a pressure differential valve which allows air to flow from atmosphere into the second chamber; and wherein air is caused to flow into the second chamber through the pressure differential valve when each piston is moved from the second cylinder end to the first cylinder end; and wherein the second chamber is sealed through the piston valve which is allowed to move to the closed position through rotational movement of the cam member of the crankshaft assembly thereby; and wherein the second chamber is sealed after the piston has travelled substantially half a length of the cylinder.

21. An internal combustion engine according to claim 20 which includes a combustion stroke which is half of a length of the cylinder and which causes the piston body to move towards the second end of the cylinder; and wherein a ventilation stroke of the internal combustion engine is caused through further movement of the piston body towards the second end of the cylinder and in which the first chamber of the cylinder is ventilated using the pressurised gas generated in the second chamber through the movement of the piston.

22. An internal combustion engine according to claim 20 wherein the combustion stroke of the piston has a combustion stroke length and the compression stroke of the piston has a compression stroke length; and wherein the outlet valve is closed at a position of rotational movement in the crankshaft assembly at which gas inside the first chamber is compressed from a position inside the cylinder which the compression stroke length of the piston is greater than the combustion stroke length.

* * * * *

UNITED STATES PATENT AND TRADEMARK OFFICE

CERTIFICATE OF CORRECTION

PATENT NO. : 8,555,828 B2
APPLICATION NO. : 13/395714
DATED : October 15, 2013
INVENTOR(S) : Jones It is certified that error appears in the above-identified patent and that said Letters Patent is hereby corrected as shown below:

In the Claims

Claim 13, column 15, line 57, after “to” delete “of”.

Signed and Sealed this
Fourth Day of February, 2014

Michelle K. Lee

Michelle K. Lee
*Deputy Director of the United States Patent and Trademark Office*